US010674828B2

(12) United States Patent
Tang

(10) Patent No.: US 10,674,828 B2
(45) Date of Patent: Jun. 9, 2020

(54) DOUBLE-LAYERED FOLDABLE STORAGE STOOL

(71) Applicant: Hongyan Tang, Jiangsu (CN)

(72) Inventor: Hongyan Tang, Jiangsu (CN)

( * ) Notice: Subject to any disclaimer, the term of this patent is extended or adjusted under 35 U.S.C. 154(b) by 0 days.

(21) Appl. No.: 16/004,306

(22) Filed: Jun. 8, 2018

(65) Prior Publication Data

US 2019/0328140 A1 Oct. 31, 2019

(30) Foreign Application Priority Data

Apr. 24, 2018 (CN) ..... 2018 2 0597614 U

(51) Int. Cl.

| | |
|---|---|
| ***A47C 9/00*** | (2006.01) |
| ***A47C 7/00*** | (2006.01) |
| ***A47C 7/62*** | (2006.01) |
| ***A47C 4/04*** | (2006.01) |
| ***A47C 7/02*** | (2006.01) |
| ***B65D 21/08*** | (2006.01) |

(52) U.S. Cl.

CPC ..... *A47C 7/628* (2018.08); *A47C 4/04* (2013.01); *A47C 7/021* (2013.01); *B65D 21/086* (2013.01)

(58) Field of Classification Search

CPC ..... A47C 7/628; A47C 4/04; A47C 7/021; B65D 21/086

USPC ..... 297/188.09, 188.12, 188.13, 423.41, 297/440.12, 461

See application file for complete search history.

(56) References Cited

U.S. PATENT DOCUMENTS

| | | | | | |
|---|---|---|---|---|---|
| 1,962,833 | A * | 6/1934 | Nuckols | A47F 5/112 | 211/135 |
| 2,049,659 | A * | 8/1936 | Parrott | A47C 5/005 | 211/73 |
| 2,361,875 | A * | 10/1944 | Sachs | A47C 5/005 | 108/150 |
| 2,390,546 | A * | 12/1945 | Mather | A47C 5/005 | 108/115 |
| 2,550,959 | A * | 5/1951 | Bowman | A47B 3/12 | 108/115 |
| 2,822,860 | A * | 2/1958 | Calabrese | A47C 5/005 | 108/115 |
| 3,126,140 | A * | 3/1964 | Lizabn et al. | A47C 5/005 | 108/115 |
| 3,174,675 | A * | 3/1965 | Rosenburg, Jr. | B65D 5/3614 | 229/108.1 |
| 3,178,227 | A * | 4/1965 | Snyder | A47C 5/005 | 229/113 |
| 3,220,362 | A * | 11/1965 | Downes | A47C 5/005 | 108/115 |
| 3,403,835 | A * | 10/1968 | Schwaner | B65D 5/32 | 229/110 |
| 3,460,790 | A * | 8/1969 | Baird | A47B 43/02 | 248/165 |

(Continued)

*Primary Examiner* — Rodney B White

(74) *Attorney, Agent, or Firm* — Wayne & Ken, LLC; Tony Hom

(57) ABSTRACT

A double-layered foldable storage stool, including a non-foldable stool cap and a foldable stool base. The front and back surfaces of the stool cap can be matched with the unfolded stool base. The stool base has a cuboid structure provided with a storage chamber, a foldable rectangular inner stool body is provided in the storage chamber of the stool base, and a support plate body is provided inside the inner stool body.

7 Claims, 9 Drawing Sheets

(56) References Cited

U.S. PATENT DOCUMENTS 3,556,593 A * 1/1971 Speegle ..... A47C 5/005 297/440.12
3,566,808 A * 3/1971 Slate, Jr. ..... A47B 3/12 108/157.14
3,620,175 A * 11/1971 Crane et al. ..... A47B 3/12 108/157.14
3,663,058 A * 5/1972 Hirsch ..... A47C 4/02 297/423.41
3,705,557 A * 12/1972 Budington ..... A47B 3/00 108/150
3,714,908 A * 2/1973 Notko ..... A47B 3/12 108/157.14
3,724,399 A * 4/1973 Notko ..... A47B 3/12 108/150
3,727,979 A * 4/1973 Schier ..... A47B 3/12 126/9 A
3,892,441 A * 7/1975 Roeshman ..... A47C 5/005 297/423.41
4,078,502 A * 3/1978 Barna ..... A47B 3/06 108/150
4,333,622 A * 6/1982 Albano ..... A47B 65/00 108/165
4,546,941 A * 10/1985 Hildebrand ..... A47C 5/005 108/115
4,556,253 A * 12/1985 Geneve ..... A47C 5/005 248/174
4,648,658 A * 3/1987 Calco ..... A47C 5/005 206/216
4,722,473 A * 2/1988 Sandrini ..... B65D 11/1833 220/646
4,813,744 A * 3/1989 Scalisi ..... A47C 5/005 297/440.12
4,841,882 A * 6/1989 Ehrman ..... A47B 7/00 108/115
4,984,848 A * 1/1991 Scalisi ..... A47C 5/005 248/152
5,018,454 A * 5/1991 Negus ..... A47B 3/06 108/150
5,382,081 A * 1/1995 Henry ..... A47C 5/005 206/815
5,394,810 A * 3/1995 Howard ..... A47B 3/00 100/157
5,697,675 A * 12/1997 DeWitt ..... A47C 5/005 297/188.01
6,048,032 A * 4/2000 Stewart ..... A47C 5/005 248/174
6,050,410 A * 4/2000 Quirion ..... B65D 19/20 206/386
6,126,239 A * 10/2000 Hazzard ..... A47C 4/02 160/231.2
6,161,901 A * 12/2000 Avner ..... A47C 5/005 108/165
6,206,473 B1 * 3/2001 Kondratiev ..... A47B 13/003 297/440.1
7,461,749 B2 * 12/2008 Hanna ..... B65D 81/02 211/27
7,472,960 B1 * 1/2009 Kuehn ..... A47C 3/16 248/174
7,581,786 B1 * 9/2009 Wang ..... A47B 83/00 297/188.11
7,625,047 B2 * 12/2009 Bertele ..... A47B 43/02 297/440.12
7,996,930 B2 * 8/2011 Carter ..... A47K 11/06 220/495.11
8,141,956 B2 * 3/2012 Schouten ..... A47C 4/04 297/440.12
8,205,935 B2 * 6/2012 Tang ..... A47C 3/16 297/17
8,240,770 B2 * 8/2012 Bertele ..... A47B 43/02 297/440.12
8,403,422 B2 * 3/2013 Wu ..... A47C 7/02 297/440.12
9,185,984 B2 * 11/2015 Henke ..... A47B 47/0008
9,788,656 B2 * 10/2017 Sanza Pilas ..... A47C 4/52
9,974,391 B2 * 5/2018 Wan ..... A47C 7/62
2005/0204968 A1 * 9/2005 Butkus ..... A47B 3/12 108/157.14
2016/0000226 A1 * 1/2016 Sanza Pilas ..... A47C 4/52 297/4
2017/0105535 A1 * 4/2017 Tang ..... A47C 4/02

* cited by examiner

DOUBLE-LAYERED FOLDABLE STORAGE STOOL

FIELD OF THE INVENTION

The invention relates to the field of stool, in particular to a double-layered foldable storage stool.

BACKGROUND OF THE INVENTION

Currently, in the field of home stool, most of existing stools are non-foldable. For the few existing foldable stools, the stool surface and the stool legs are connected via hinges, and the stools are still bulky in the folded state, especially in terms of height and length. The folded stools occupy large area and are not suitable for usage, carrying and storage in households with limited space. At the same time, existing foldable stools do not have a storage function and cannot meet the needs of family storage.

SUMMARY OF THE INVENTION

In order to solve the abovementioned technical problem, the applicant has paid lots of effort, and provides a double-layered foldable storage stool. The foldable storage stool is small in size in its folded state, and is convenient to carry and store. Further, the stool has a storage function while occupies small area.

The technical solution of the present invention is explained in the following.

A double-layered foldable storage stool comprising a non-foldable stool cap and a foldable stool base, both of front and back surfaces of the stool cap can be matched with the unfolded stool base, the stool base comprises a cuboid structure provided with a first storage chamber, a foldable rectangular inner stool body is provided in the first storage chamber of the stool base, and a support plate body is provided inside the inner stool body.

Its further technical solutions are as follows.

The stool base comprises a plurality of first plate bodies connected with each other, which enclose the cuboid first storage chamber, the plurality of first plate bodies is connected and covered by cloth to form the stool base, a first fold line arranged longitudinally is formed between two adjacent first plate bodies, a first flexible closure member is provided at the bottom of the first storage chamber, a slot is opened along one of diagonal lines of the first flexible closure member, and the stool base is folded via the slot and the first fold line;

The inner stool body comprises a plurality of second plate bodies connected with each other, which enclose a cuboid second storage chamber, a second flexible closure member is provided at the bottom of the inner stool body, the inner stool body is arranged in the first storage chamber, a second fold line is provided at least at each of the center lines of two opposed second plate bodies, and the inner stool body can be unfolded or folded along the second fold line;

The stool cap comprises a cuboid rigid plate body, a soft surface layer is wrapped on one side of the rigid plate body, a table board is connected on the other side of the rigid plate body, the table board is smaller than the rigid plate body, and the table board matches with an opening of the second storage chamber;

A first puller is further provided on one side of the stool cap; The support plate body is a rigid sandwich plate, and a second puller (5) is arranged on the support plate body;

The stool base has a square cross-section, the first plate bodies are drawn close along one of diagonal lines of the stool base and come into contact with an adjacent first plate body, wherein after two adjacent first plate bodies abut against each other to form a rectangular structure, the stool base is folded along the first fold line;

The stool base is a cuboid structure enclosed by long-side plate bodies and short-side plate bodies, a third fold line is provided at the longitudinal center line of the short-side plate body, perpendicular to the first flexible closure member.

The present invention achieves the following beneficial effects.

The present invention has a simple structure and is easy to use. In the present invention, both of the stool base and the inner stool body are foldable, and the folded stool occupies less space. The cap body can realize both the functions of a seat and a table board, respectively, and is simple and pleasant in appearance. The present stool is compact in size when in its folded state and is convenient to carry. The present stool can be rapidly assembled and disassembled and facilitates easy storage.

REFERENCE SIGNS

1. stool base; 11. first storage chamber; 111. first plate body; 101. first flexible closure member; 102. slot; 103. first fold line; 2. inner stool body; 21. second storage chamber; 201. second fold line; 202. second flexible closure member; 211. second plate body; 3. stool cap; 301. rigid plate body; 302. table board; 303. first puller; 4. support plate body; 5. second puller; 601. long-side plate; 602. short-side plate; 6021. third fold line.

DETAILED DESCRIPTION OF THE INVENTION

Figure 1:
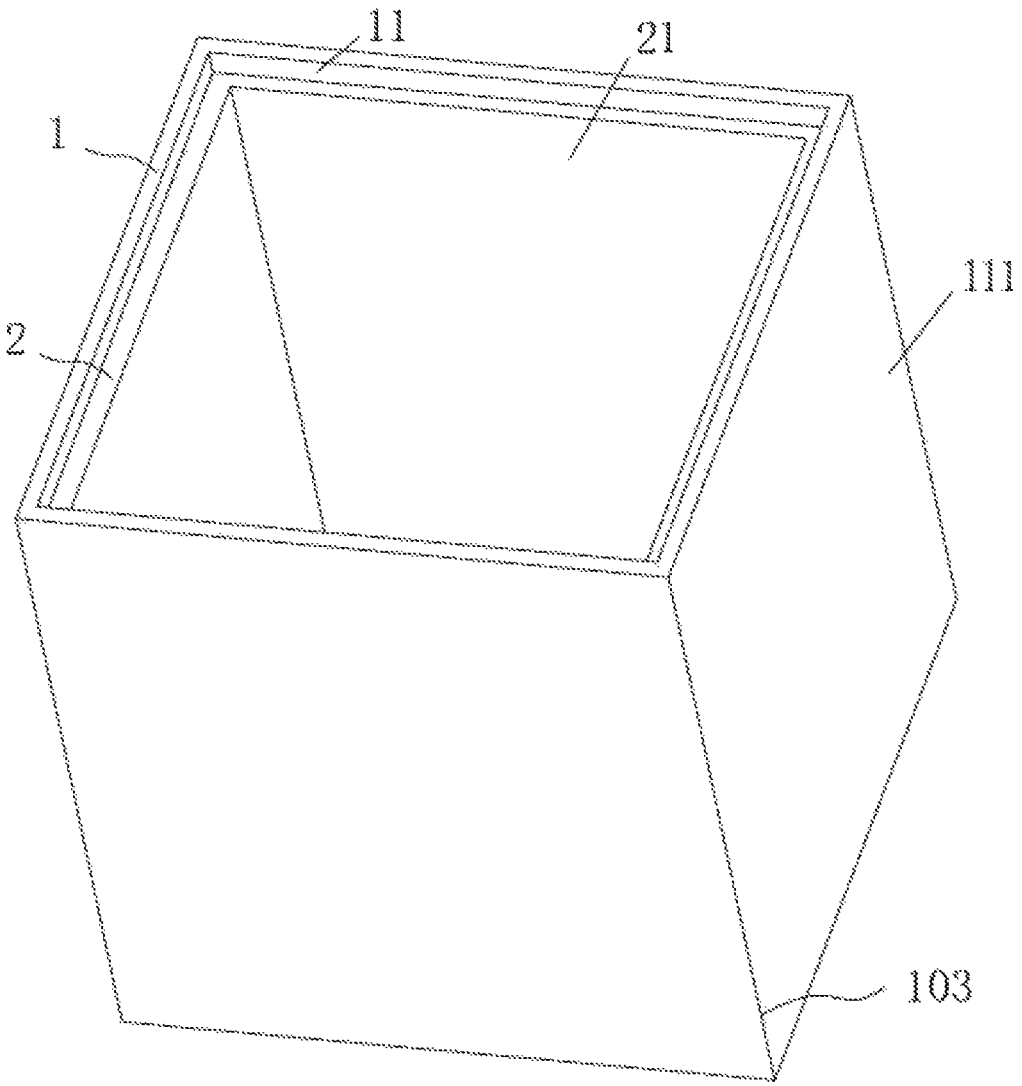
FIG. 1 is a schematic view of a connection structure between a stool base and an inner stool body according to the present invention.
Figure 4:
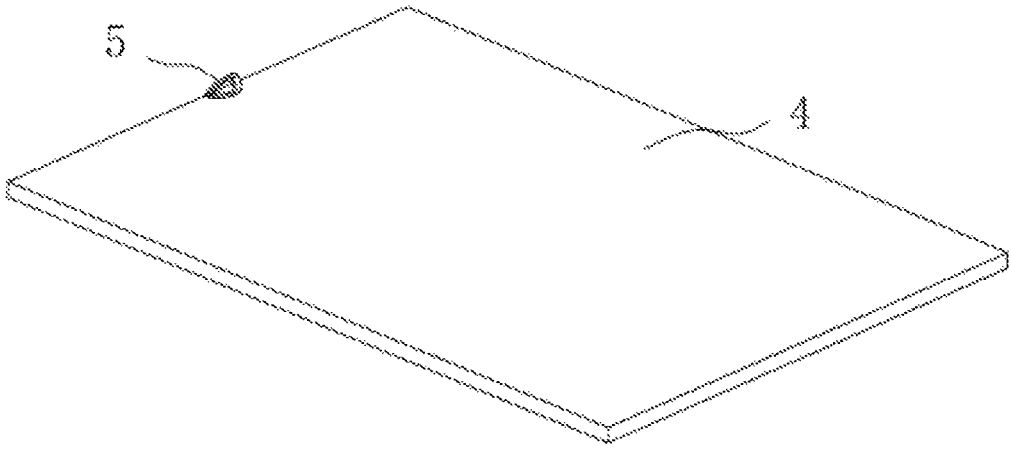
FIG. 4 is a schematic structural view of a support plate body according to the present invention.

As shown in FIG. 1, the double-layered foldable storage stool comprises a non-foldable stool cap 3 and a foldable stool base 1. Both of front and back surfaces of the stool cap 3 can be matched with the unfolded stool base 1. The stool base 1 comprises a cuboid structure provided with a first storage chamber 11. A foldable rectangular inner stool body 2 is provided in the first storage chamber 11 of the stool base 1, and a support plate body 4 is provided inside the inner stool body 2. As shown in FIG. 4, the support plate body 4 is a rigid sandwich plate, and a second puller 5 is provided on the support plate body 4.

As shown in FIG. 1, the stool base 1 comprises a plurality of first plate bodies 111 connected with each other, which enclose the cuboid first storage chamber 11. The first storage chamber 11 is in the form of a cuboid or a cube. The plurality of first plate bodies 111 is connected and covered by cloth to form the stool base 1. A first fold line 103 arranged longitudinally is formed between two adjacent first plate bodies 111. A first flexible closure member 101 is provided at the bottom of the first storage chamber 11, and a slot 102 is opened along one of diagonal lines of the first flexible closure member 101. The stool base 1 is folded via the slot 102 and the first fold line 103. When the stool base 1 is a cuboid structure enclosed by long-side plate bodies 601 and short-side plate bodies 602, a third fold line is provided at the longitudinal center line of the short-side plate body 602, perpendicular to the first flexible closure member 101. When the stool base 1 is a cube structure, the first plate bodies 111 are drawn close along one of diagonal lines of the stool base 1 and come into contact with an adjacent first plate body, wherein after two adjacent first plate bodies abut against each other so that the stool base forms a rectangular structure, the stool base is folded along the first fold line 103.

Figure 2:
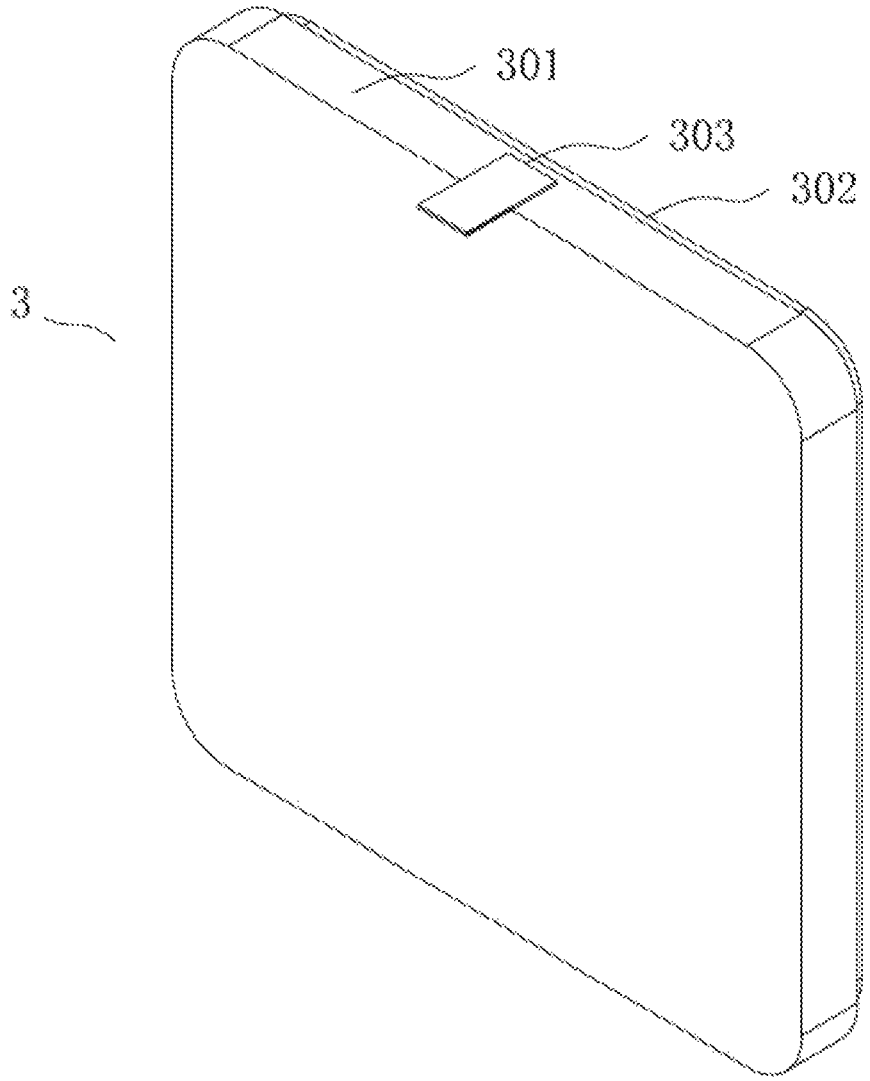
FIG. 2 is a schematic structural view I of a stool cap of the present invention.

As shown in FIG. 2, the inner stool body 2 comprises a plurality of second plate bodies 211 connected with each other, which enclose a cuboid second storage chamber 21. The second storage chamber 21 is in the form of a cuboid or a cube. A second flexible closure member 202 is provided at the bottom of the inner stool body 2. The inner stool body 2 is arranged in the first storage chamber 11, and a second fold line 201 is provided at least at each of the center lines of two opposed second plate bodies 211. The inner stool body 2 can be unfolded or folded along the second fold line 201.

Figure 3:
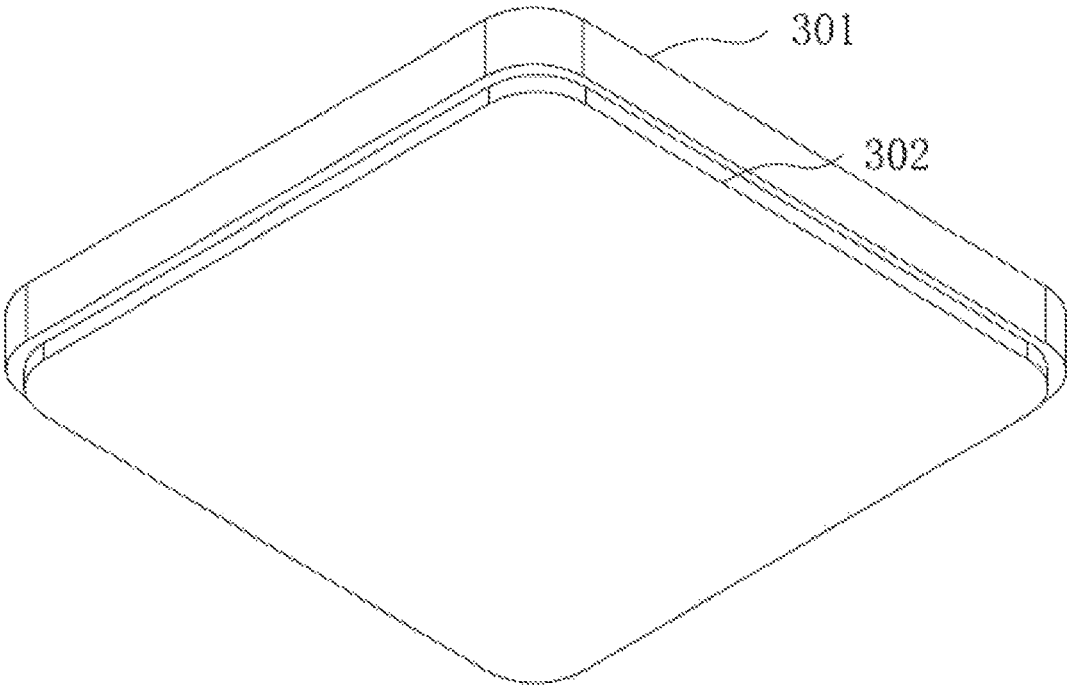
FIG. 3 is a schematic structural view II of a stool cap according to the present invention.

As shown in FIG. 2 and FIG. 3, the stool cap 3 comprises a cuboid rigid plate body 301. A soft surface layer is wrapped on one side of the rigid plate body 301, and a table board 302 is connected on the other side of the rigid plate body 301. The table board 302 is smaller than the rigid plate body 301, and the table board 302 matches with an opening of the second storage chamber 21. A first puller 303 is further provided on one side of the stool cap 3.

The specific folding process of the present invention is described in the following.

Figure 5:
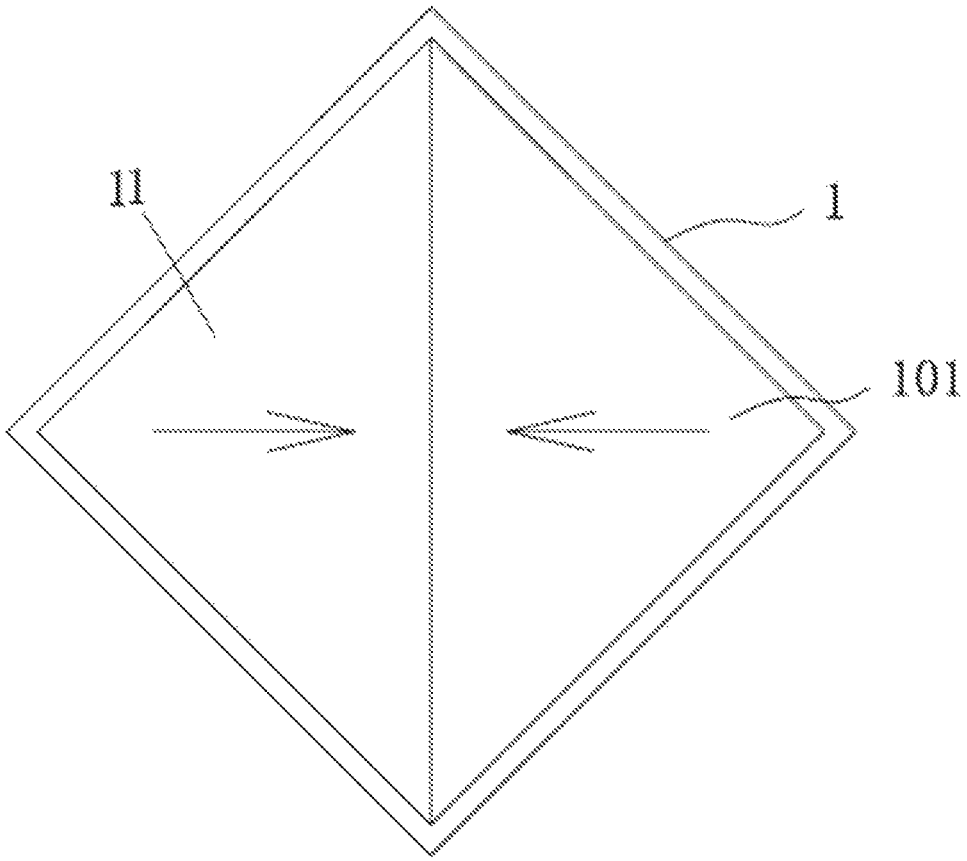
FIG. 5 is a schematic view I of folding of the stool base according to the present invention.
Figure 6:
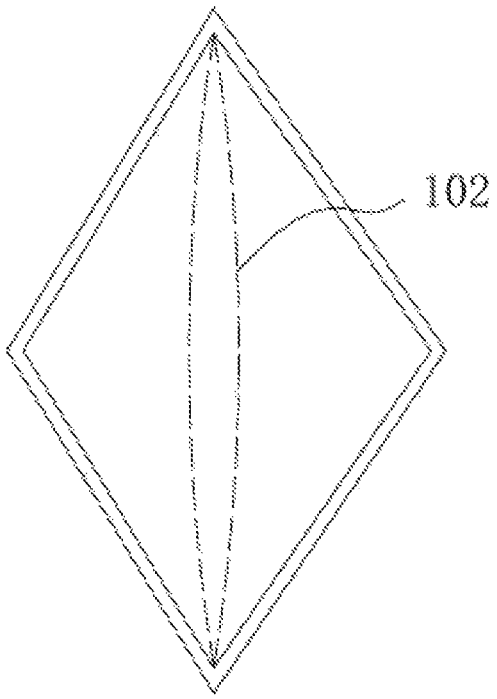
FIG. 6 is a schematic view II of folding of the stool base according to the present invention.
Figure 7:
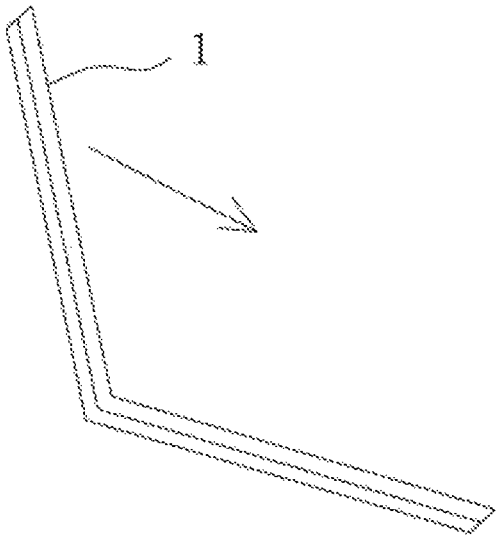
FIG. 7 is a schematic view III of folding of the stool base according to the present invention.

As shown in FIG. 5, when the stool base 1 has a cube structure, the first plate bodies 111 are drawn close along one of the diagonal lines along the direction indicated by the arrow along the seat 1 (the drawing direction depends on the extending direction of the slot 102 on the first flexible closure member 101). As shown in FIG. 6 and FIG. 7, when two adjacent first plate bodies 111 are in contact with each other to form a rectangular structure, two of the first plate bodies 111 are folded onto the other two first plate bodies 111 along the first fold line 103, and folding of the stool base 1 is achieved.

Figure 9:
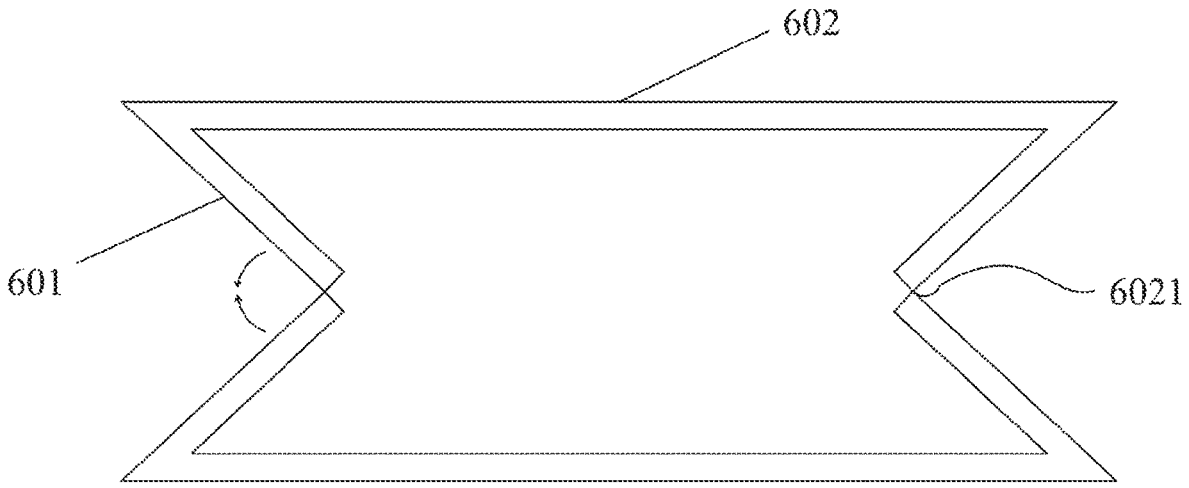
FIG. 9 is a schematic view of folding of the rectangular stool base according to the present invention.

As shown in FIG. 9, when the stool base 1 is a cuboid structure enclosed by the long-side plate bodies 601 and the short-side plate bodies 602, the short-side plate bodies 602 are folded inwardly in the shape of V along the third fold line 6021. The folding of the stool base 1 is completed via the first fold line 103 and the third fold line 6021.

Figure 8:
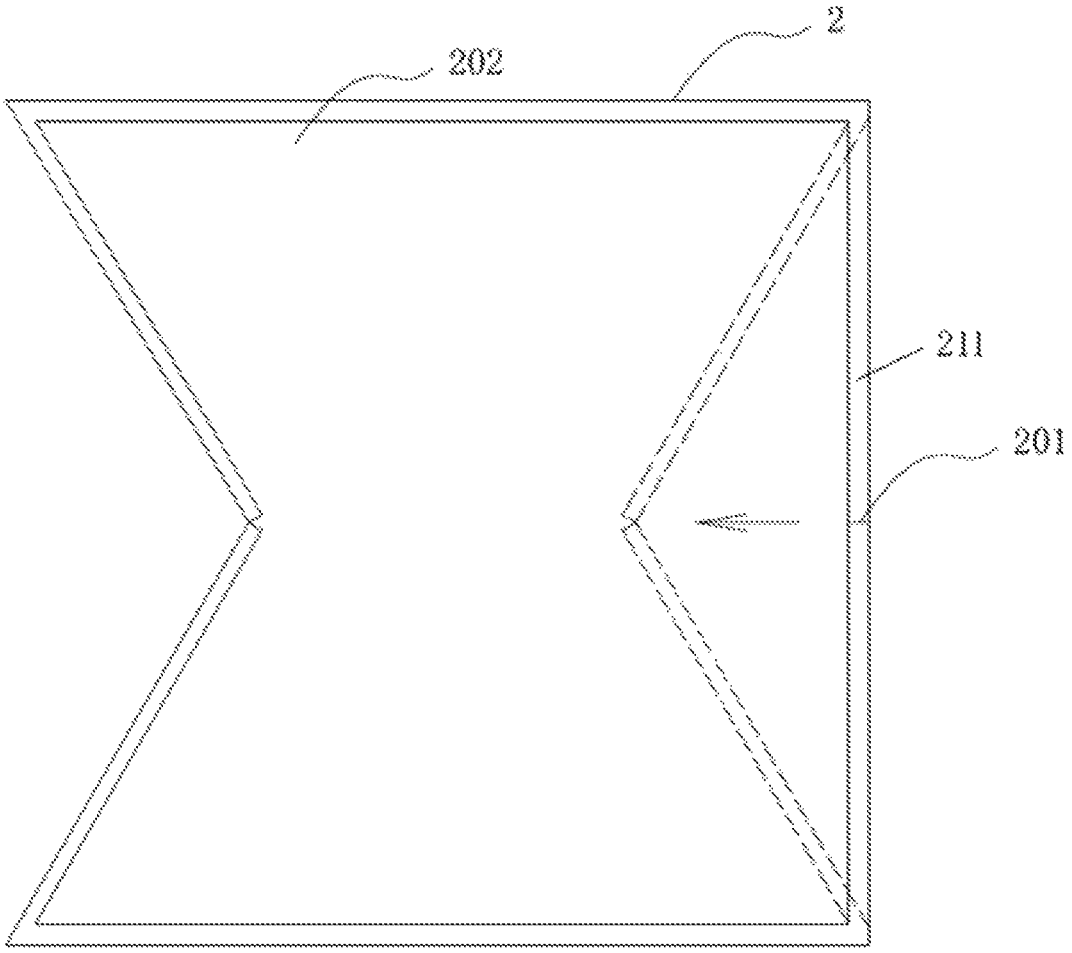
FIG. 8 is a schematic view of folding of the inner stool body according to the present invention.

The folding manner of the inner stool body 2 is shown in FIG. 8. A pair of two opposed second plate bodies 211 of the inner stool body 2 are folded inwardly in the shape of V along the second fold line 201. The folding is achieved when the two second plate bodies 211 overlap each other.

In use, the unfolded inner stool body 2 is placed in the first storage chamber 11 of the stool base 1, and the outer wall of the inner stool body 2 is fitted with the inner wall of the first storage chamber 11. The stool base 1 is an outer jacket type structure engaged with the inner stool body 2. Then the stool cap 3 is covered on and engaged with the stool base 1 in a way that the side of the stool cap wrapped with the soft surface layer faces upwards. Thus, the function of a seat is achieved. When the side of the stool cap 3 provided with the table board 302 faces upwards, and the side of the stool top cap 3 provided with the soft surface layer is covered on and engaged with the stool base 1, the function of a small table is achieved.

The present invention has a simple structure and is easy to use. In the present invention, both of the stool base 1 and the inner stool body 2 can be folded, and the folded stool occupies less space. The cap body can realize both the functions of a seat and a table board, respectively, and is simple and pleasant in appearance. The present stool is compact in size when in its folded state and is convenient to carry. The present stool can be rapidly assembled and disassembled and facilitates easy storage.

The above description is intended to explain rather than limit the present invention. The scope of the present invention is defined by the claims. Without departing from the basic principle of the present invention, the present invention can be modified in various ways.

What is claimed is:

1. A double-layered foldable storage stool, comprising:

a non-foldable stool cap and a foldable stool base; wherein both of the front and back surfaces of the stool cap is matchable with the stool base in an unfolded state; the stool base comprises a cuboid structure provided with a first storage chamber, a foldable rectangular inner stool body is provided in the first storage chamber of the stool base, and a support plate body is provided inside the inner stool body;

the inner stool body comprises a plurality of second plate bodies connected with each other, which enclose a cuboid second storage chamber; a second flexible closure member is provided at the bottom of the inner stool body; the inner stool body is arranged in the first storage chamber; a second fold line is provided at least at each of center lines of two opposed second plate bodies, and the inner stool body can be unfolded or folded along the second fold line.

2. The double-layered foldable storage stool of claim 1, wherein the stool base comprises a plurality of first plate bodies connected with each other, which enclose the cuboid first storage chamber; the plurality of first plate bodies are connected and covered by cloth to form the stool base; a first fold line arranged longitudinally is formed between two adjacent first plate bodies; a first flexible closure member is provided at a bottom of the first storage chamber; a slot is formed on the first flexible closure member in a diagonal direction of a surface of the first flexible closure member; and the stool base is folded along the first fold line through the slot.

3. The double-layered foldable storage stool of claim 2, wherein the stool base has a square cross-section, the first plate bodies are drawn close along one of diagonal lines of the stool base and come into contact with an adjacent first plate body, wherein after two adjacent first plate bodies abut against each other to form a rectangular structure, the stool base is folded along the first fold line.

4. The double-layered foldable storage stool of claim 2, wherein the stool base is a cuboid structure enclosed by long-side plate bodies and short-side plate bodies, a third fold line is provided at a longitudinal center line of the short-side plate body perpendicular to the first flexible closure member.

5. The double-layered foldable storage stool of claim 1, wherein the stool cap comprises a cuboid rigid plate body, a soft surface layer is wrapped on one side of the rigid plate body, a table board is connected on the other side of the rigid plate body, the table board is smaller than the rigid plate body, and the table board matches with an opening of the second storage chamber.

6. The double-layered foldable storage stool of claim 5, wherein a first puller is further provided on one side of the stool cap.

7. The double-layered foldable storage stool of claim 6, wherein the support plate body is a rigid sandwich plate, and a second puller is arranged on the support plate body.

* * * * *